United States Patent [19]

Coons, III et al.

[11] Patent Number: 5,060,345

[45] Date of Patent: Oct. 29, 1991

[54] LOOP CUTTER FOR BULKED CONTINUOUS FILAMENTS

[75] Inventors: Andrew M. Coons, III, Anderson; James L. Bradley, Starr, both of S.C.

[73] Assignee: BASF Corporation, Parsippany, N.J.

[21] Appl. No.: 490,170

[22] Filed: Mar. 7, 1990

[51] Int. Cl.[5] ..... D01G 3/00

[52] U.S. Cl. ..... 19/0.6

[58] Field of Search ..... 57/2, 114, 908; 19/46, 19/0.51, 0.58, 0.60, 0.62, 0.64; 83/19, 402, 913

[56] References Cited

U.S. PATENT DOCUMENTS

| | | | |
|---|---|---|---|
| 415,419 | 11/1889 | Nichols . | |
| 2,184,254 | 12/1939 | Koster . | |
| 2,217,766 | 10/1940 | Neff | 19/0.51 X |
| 2,418,125 | 4/1947 | Koster et al. | 19/0.56 X |
| 2,747,668 | 5/1956 | Keefe, Jr. | 83/402 |
| 2,852,906 | 9/1958 | Breen . | |
| 2,962,794 | 12/1960 | Field, Jr. . | |
| 3,001,358 | 9/1961 | Mayner . | |
| 3,364,540 | 1/1968 | McIntosh et al. | 19/0.64 X |
| 3,379,808 | 4/1968 | McIntosh et al. . | |
| 3,714,686 | 2/1973 | Schmid et al. . | |
| 3,831,473 | 8/1974 | Fleissner | 83/913 X |
| 3,946,548 | 3/1976 | Hino et al. | 19/0.64 X |
| 4,009,629 | 3/1977 | Thomas, Jr. et al. | 83/913 X |
| 4,016,626 | 4/1977 | Guillermin et al. | 19/0.46 |
| 4,265,082 | 5/1981 | Sasaki et al. . | |
| 4,522,774 | 6/1985 | Donnelly et al. . | |
| 4,554,849 | 11/1985 | Benham | 83/19 X |
| 4,674,271 | 6/1987 | Bird . | |

FOREIGN PATENT DOCUMENTS

| | | | |
|---|---|---|---|
| 2752068 | 5/1979 | Fed. Rep. of Germany | 19/0.6 |
| 50-5290 | 3/1975 | Japan | 19/0.6 |
| 1110829 | 4/1982 | U.S.S.R. | 19/0.6 |
| 692369 | 6/1953 | United Kingdom | 19/0.6 |
| 706375 | 3/1954 | United Kingdom | 19/0.6 |
| 823228 | 11/1959 | United Kingdom | 19/0.6 |

*Primary Examiner*—Werner H. Schroeder
*Assistant Examiner*—John J. Calvert
*Attorney, Agent, or Firm*—Tom R. Vestal; Karen M. Dellerman

[57] ABSTRACT

An apparatus and method are described for the manufacture of cut looped end crimp yarns in which the yarn is stably supported during the loop cutting operation.

6 Claims, 2 Drawing Sheets

LOOP CUTTER FOR BULKED CONTINUOUS FILAMENTS

BACKGROUND OF THE INVENTION

A primary complaint regarding today's synthetic yarns is that their method of manufacture presents a product, though satisfactory from a dyeing and handling use, which has a touch or "hand", when in the form of garments, that is less than satisfactory. The filaments are formed utilizing spinning apparatus which cause the surface of the filaments to be substantially smooth. When formed into a garment structure, these filaments have a tendency to be cold to the touch and generally lack the feel that one has become to expect from materials made of natural fibers, e.g. cotton and wool.

In view of this drawback of "man-made" filaments, yarn producers and garment manufacturers have sought to modify filament, structures in a number of ways over the years. Continuous filament tow is cut into small segments called staple fibers and passed through apparatus such as open spinning machines (such as those used in open-end spinning or flyer spinning) which form the staple fibers into a yarn. In the staple fiber yarn sometimes referred to as "spun" yarn from the spinning operation, the ends of the various cut lengths protrude from the yarn more like wool or other natural fibers, thus producing a feel more like the natural yarns.

It has also been known to crinkle and twist the continuous filaments in a manner that causes the filaments to retain their contorted shape to some extent, and this "texturing" of the continuous filaments also tends to produce a warmer, less harsh feel than non-textured filaments.

It is also known to combine the crimping and staple fiber process in such a manner that presents the feel of both processes in the final product.

It is also known to convert continuous filament yarns to staple-like yarns by breaking certain of the yarns in a process of manufacture of the overall yarn. This has been accomplished in U.S. Letters Pat. No. 3,379,808, for example, by rotating the bristles of a circular steel brush over the surface filaments of a yarn passing over a processing godet each pass the yarn makes over the godet.

Filaments of a continuous filament yarn were broken according to U.S. Letters Pat. No. 2,184,254 by passing the yarn over an abrasive wheel during the winding process. Further U.S. Letters Pat. No. 415,419 describes and depicts a process in a ring spinning frame in which a yoke built in the ring traveler of such a frame has serrations on its inner edge. Yarns being spun onto a package in the spinning frame contact the serrations and the filaments on the surface thereof are broken or cut.

In U.S. Letters Pat. No. 3,001,358 there is shown a process in which a cutting wheel having spaced severing sections is placed perpendicularly to the path of travel of a yarn in a false twisting area. The filaments of the false twisted yarn are broken on the surface and produce a bulkiness and hand similar to staple fibers. A principle difficulty with this latter process is that the yarns passing through the cutting process are not supported and have a tendency to "bounce" on the serrating surface and produce a non-uniform product. The present invention is directed to an apparatus that provides a controlled yarn during the loop severing process.

BRIEF DESCRIPTION OF THE INVENTION

In the present invention there is provided a means for passing a continuous filament yarn through a loop cutting process in a manner that the yarn is stabilized or fixed in a predetermined position along its axis length while passing through the loop cutting device. The invention further comprises a process for the manufacture of a textured loop cut yarn which comprises passing the yarn through a texturing device which forms the yarn into a series of crunodal loops and coils that extend from the base section of the yarn, and thereafter passing the yarn through a concentrating device which positions the yarn substantially in a predetermined manner while a loop severing device cuts the crunodal loops of the yarn passing through the device.

A DETAILED DESCRIPTION OF THE DRAWINGS

Figure 1:
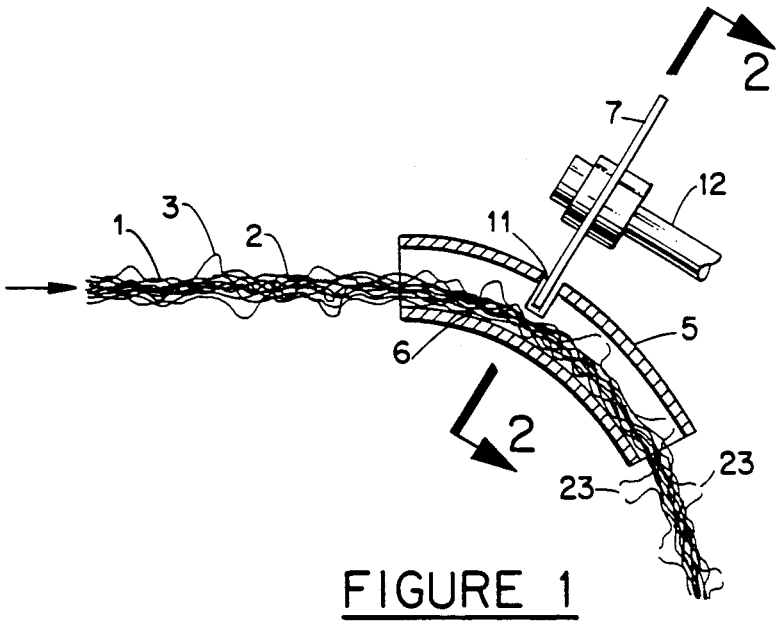
FIG. 1 is a side-view schematic of the invention depicting one embodiment of the apparatus for converting continuous multifilament yarn to staple-like yarn.

In the invention a crimped and textured yarn 1, having a base section 2 and crunodal loops 3 from a supply source 4 (not shown), is fed through a tubular device 5 which has a curved inner surface over which the yarn passes. A serrated edge cutting wheel 7 is disposed substantially perpendicularly to the path of the yarn and the toothed sections are positioned such that they just clear the base section 2 of the yarn 1. This permits the toothed section 8 of the cutting wheel 7 to cut the crunodal loops 3 of the yarn 1 as the yarn passes through tube 5 during rotation of the cutting wheel 7.

Figure 2:
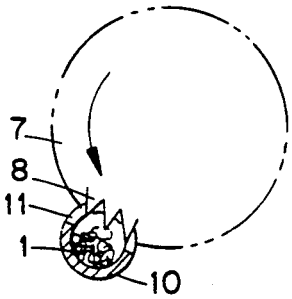
FIG. 2 shows the embodiment in FIG. 1 along section lines 2—2.
Figure 3:
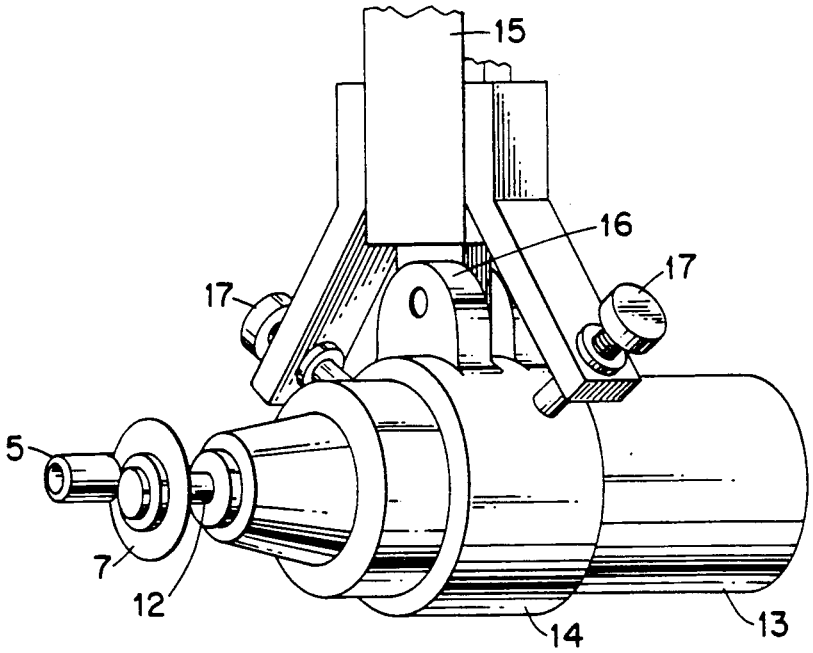
FIGS. 3 and FIG. 4 depict a further embodiment of the invention.

The cutting wheel 7 extends into the tubing 5 through a slit 11 cut into the outer surface of the tube 5, thus leaving a section 10 holding the sections of tubing 5 together in a stable condition and providing a firm backing for the yarn 1 as it passes through the tubing (as shown in FIG. 2). In FIG. 3 the tubing 5 is supported by a means not shown. The serrated cutting wheel 7 is attached via shaft 12 to an electric motor 13. The motor is supported by a bracket 14 which pivots about a connecting section 16 to a frame 15. Centering screws 17 position bracket 14 and thus the cutting wheel 7 relative to the tubing 5, providing an accurate means of positioning the cutting edges 8 of the wheel relative to the crunodal loop sections 3 of the yarn 1.

Figure 4:
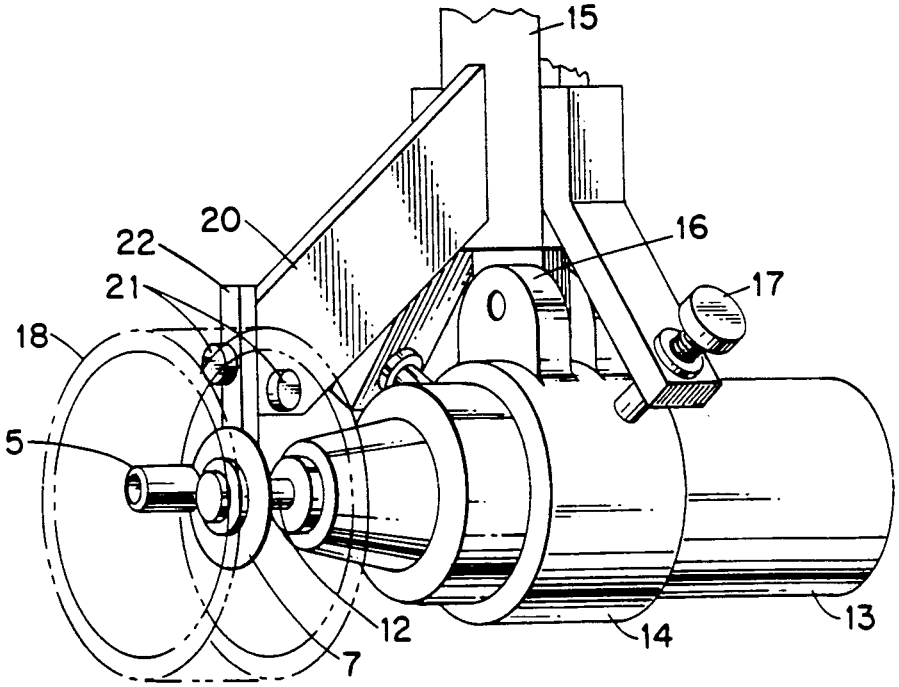

In FIG. 4 an alternate embodiment is depicted in which the device of FIG. 3 has a guard device 18 protecting workers from the rotating cutting wheel. The guard 18 is attached to frame 15 by a flange section 20. In this particular embodiment the positioning of tubing 5 relative to the cutting wheel can also be made by adjustment screws 21 adjusting the shaft 22 to which tubing 5 is affixed.

Figure 5:
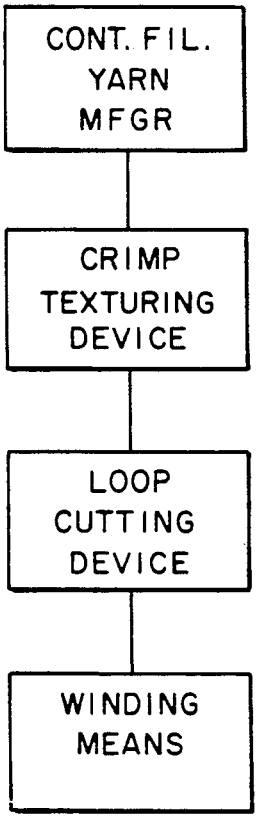
FIG. 5 is a schematic diagram of a texturing process incorporating the loop cutting device in this invention.

In FIG. 5 a schematic of a texturing process utilizing the present invention is depicted. A continuous filament yarn is manufactured through a melt spinning process or otherwise. The formed yarn is thereafter processed in a texturing process, preferably a crimp texturing process. The yarn may be texturized simultaneously in the solution or melt-spinning operation or it may be first wound onto a package and then fed from the package to the texturing section. Typical crimp-texturing is shown in U.S. Letters Pat. Nos. 4,522,774 and 3,714,686. Thereafter, the yarn is fed to the loop cutting device as shown in FIG. 1, for example, where the crunodal loops are broken but continue to project from the base of the yarn (as shown in FIG. 1 by reference 23). The thus textured yarn may be then passed to a fluid jet tangling device to smooth the open ends of the filaments or alternatively, the yarn may be passed through a friction device such as shown in FIG. 5 of U.S. Letters Pat. No. 3,001,358.

The textured yarns for use in the invention herein may also be manufactured utilizing yarn volumizing apparatus similar to that shown in U.S. Letters Pat. Nos. 2,852,906 and 2,962,794 in which continuous filament yarns are fed under reduced tension or overfed into a high velocity stream of fluid in a manner that causes the filaments to whip about themselves and become entangled. The surface of the filament structure thus formed exhibits large loops, loosely intermingled and randomly distributed. The loops are confined by the inter-filamentary structure.

The process of the invention lends itself to loop cutting of all types of polymers presently used in the manufacture of garments today. The yarn 1 may comprise all continuous filaments or a combination of continuous filaments in staple fibers. Various effects can be obtained by adjustment of the distance of rotation of the cutting wheel 7 from the yarn 1. Other modifications will be apparent to those skilled in the art.

I claim:

1. An apparatus for converting continuous multifilament yarn to staple-like yarn, comprising a curved tube and means for securing the tube to a yarn processing frame, a transverse slot formed partway in the outer peripheral surface of the tube between the ends of the tube, and a moveable cutting surface extending a predetermined distance into the slot, whereby crunodal filament loops of a textured yarn passing through the curved tube will be severed by the cutting surface yet core filaments will not.

2. The apparatus of claim 1, wherein the moveable cutting surface comprises a rotatable serrated cutting wheel.

3. The apparatus of claim 2, wherein said rotatable cutting wheel has means for adjustment of the wheel in said slot relative to crunodal filaments in a yarn passing through the apparatus.

4. The apparatus of claim 2, wherein means for rotating said wheel comprise rotary motor means and connecting shaft therefore.

5. A process for converting to staple-like yarn a continuous filament yarn having crunodal or other loops extending from the surface of the yarn, the steps comprising moving said yarn along its length through a concentrating device where the relative movement of the yarn other than lengthwise is inhibited; moving transversely in said concentrating device a rotatable cutting means adjacent to the surface of the yarn; and cutting the loops without cutting the core filaments of the yarn.

6. A process for converting to staple-like yarn a continuous filament yarn having crunodal or other loops extending from the surface of the yarn, comprising passing the yarn through the inner side of a curved tube; extending a cutting means through a transverse slot formed partway in the outer peripheral surface of the tube; and cutting the loops of the yarn with said cutting means but not the surface filaments of the yarn as the yarn passes lengthwise through the tube.

* * * * *